US012486014B2

(12) United States Patent
Ikegaya

(10) Patent No.: US 12,486,014 B2
(45) Date of Patent: Dec. 2, 2025

(54) MARINE PROPULSION SYSTEM AND MARINE VESSEL

(71) Applicant: YAMAHA HATSUDOKI KABUSHIKI KAISHA, Iwata (JP)

(72) Inventor: Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 574 days.

(21) Appl. No.: 17/970,617

(22) Filed: Oct. 21, 2022

(65) Prior Publication Data

US 2023/0140061 A1 May 4, 2023

(30) Foreign Application Priority Data

Nov. 4, 2021 (JP) ..... 2021-180109

(51) Int. Cl.
*B63H 25/42* (2006.01)
*B63H 25/02* (2006.01)

(52) U.S. Cl.
CPC ..... *B63H 25/42* (2013.01); *B63H 25/02* (2013.01); *B63H 2025/026* (2013.01)

(58) Field of Classification Search
CPC ..... B63H 25/00; B63H 25/02; B63H 25/42; B63H 2025/026
USPC ..... 440/1
See application file for complete search history.

(56) References Cited

U.S. PATENT DOCUMENTS

| | | | | |
|---|---|---|---|---|
| 4,854,902 | A | 8/1989 | Havins | |
| 5,016,553 | A | 5/1991 | Spencer | |
| 6,305,994 | B1 * | 10/2001 | Bland | B63H 25/42 440/6 |
| 9,988,134 | B1 * | 6/2018 | Gable | B63H 25/42 |
| 10,739,771 | B2 * | 8/2020 | Miller | B63H 25/42 |
| 12,252,227 | B2 * | 3/2025 | Ikegaya | B63H 25/42 |
| 2006/0234566 | A1 | 10/2006 | Ando | |
| 2011/0166724 | A1 | 7/2011 | Hiramatsu | |
| 2019/0179318 | A1 | 6/2019 | Miller et al. | |

FOREIGN PATENT DOCUMENTS

| | | | |
|---|---|---|---|
| EP | 3000718 | A1 | 3/2016 |
| JP | 2006-291927 | A | 10/2006 |
| JP | 2010-143321 | A | 7/2010 |
| JP | 2011-140272 | A | 7/2011 |
| JP | 2014-080077 | A | 5/2014 |

OTHER PUBLICATIONS

Extended European Search Report in EP22201222.1, mailed Mar. 24, 2023, 7 pages.

* cited by examiner

*Primary Examiner* — Lars A Olson
(74) *Attorney, Agent, or Firm* — Keating & Bennett, LLP

(57) ABSTRACT

A marine propulsion system includes a controller configured or programmed to perform a control to rotate a hull by driving an auxiliary propulsion device having a maximum output smaller than a maximum output of a main propulsion device and having a steering angle range wider than a steering angle range of the main propulsion device without generating a thrust from the main propulsion device.

18 Claims, 4 Drawing Sheets

MARINE PROPULSION SYSTEM AND MARINE VESSEL

CROSS REFERENCE TO RELATED APPLICATIONS

This application claims the benefit of priority to Japanese Patent Application No. 2021-180109 filed on Nov. 4, 2021. The entire contents of this application are hereby incorporated herein by reference.

BACKGROUND OF THE INVENTION

1. Field of the Invention

The present invention relates to a marine propulsion system and a marine vessel, and more particularly, it relates to a marine propulsion system and a marine vessel each including a plurality of propulsion devices and a controller to perform a control to rotate a hull.

2. Description of the Related Art

A marine vessel including a plurality of propulsion devices and a controller to perform a control to rotate a hull is known in general. Such a marine vessel is disclosed in Japanese Patent Laid-Open No. 2011-140272, for example.

Japanese Patent Laid-Open No. 2011-140272 discloses a marine vessel including a hull, a plurality of outboard motors (propulsion devices) to provide a propulsive force for the hull, and a hull ECU (controller) to control driving of the plurality of outboard motors. In the marine vessel described in Japanese Patent Laid-Open No. 2011-140272, the plurality of outboard motors include a right outboard motor attached on the starboard side of the hull and a left outboard motor attached on the port side of the hull. When a vessel operator operates an operator to rotate the hull, the hull ECU performs a control to rotate the hull by driving both the right outboard motor and the left outboard motor. In this description, the terms "rotate the hull", "the hull is rotated", "rotating the hull", etc. indicate changing the orientation of the bow while maintaining the position of the hull, unlike turning of the hull accompanied by forward or rearward movement of the hull.

Although not clearly described in Japanese Patent Laid-Open No. 2011-140272, in the marine vessel described in Japanese Patent Laid-Open No. 2011-140272, the plurality of outboard motors conceivably have the same structure as each other. That is, in the marine vessel described in Japanese Patent Laid-Open No. 2011-140272, the plurality of outboard motors conceivably have the same maximum output as each other. On the other hand, a conventional marine vessel as described in Japanese Patent Laid-Open No. 2011-140272 may include a plurality of outboard motors (propulsion devices) having different maximum outputs. In such a case, a hull ECU (controller) needs to perform a control to rotate a hull by driving both the outboard motors having different maximum outputs, and thus the control to rotate the hull is conceivably relatively complex. Therefore, in a structure including a plurality of outboard motors having different maximum outputs, it is desired to rotate a hull while preventing a control by a hull ECU (controller) from being complex. In the field of marine vessels, from the viewpoint of SDGs (Sustainable Development Goals), it is desired to reduce the environmental burdens, such as reducing the amount of carbon dioxide emissions associated with driving propulsion devices.

SUMMARY OF THE INVENTION

Preferred embodiments of the present invention provide marine propulsion systems and marine vessels that each rotate hulls while preventing controls by controllers from being complex when including a plurality of propulsion devices having different maximum outputs.

A marine propulsion system according to a preferred embodiment of the present invention includes a main propulsion device to be attached to a stern of a hull and operable to rotate in a right-left direction to change a direction of a thrust, an auxiliary propulsion device to be attached to the stern, including an electric motor to drive an auxiliary thruster to generate a thrust, operable to rotate in the right-left direction to change a direction of the thrust, having a maximum output smaller than a maximum output of the main propulsion device, and having a steering angle range wider than a steering angle range of the main propulsion device, and a controller configured or programmed to perform a control to rotate the hull by driving the auxiliary propulsion device without generating the thrust from the main propulsion device.

In a marine propulsion system according to a preferred embodiment of the present invention, the controller is configured or programmed to perform a control to rotate the hull by driving the auxiliary propulsion device having a maximum output smaller than a maximum output of the main propulsion device and a steering angle range wider than a steering angle range of the main propulsion device without generating a thrust from the main propulsion device. Accordingly, although the main propulsion device and the auxiliary propulsion device have different maximum outputs, the auxiliary propulsion device is driven without generating a thrust from the main propulsion device in the control to rotate the hull, and thus as compared with a case in which a thrust is generated from the main propulsion device and the auxiliary propulsion device is driven, the control by the controller to rotate the hull is prevented from being complex. Furthermore, the auxiliary propulsion device has a steering angle range wider than a steering angle range of the main propulsion device, and thus even when a thrust is not generated from the main propulsion device, the hull is easily rotated by driving the auxiliary propulsion device. Consequently, in a structure including a plurality of propulsion devices having different maximum outputs, the hull is rotated while the control by the controller is prevented from being complex.

In a marine propulsion system according to a preferred embodiment of the present invention, the controller is configured or programmed to perform a control to rotate the hull by driving the auxiliary propulsion device including the electric motor to drive the auxiliary thruster to generate a thrust without generating a thrust from the main propulsion device. Accordingly, unlike the engine, the electric motor does not directly emit carbon dioxide, and thus as compared with a case in which the auxiliary propulsion device including the electric motor is not used when the hull is rotated, from the viewpoint of SDGs, a preferable device structure is achieved.

In a marine propulsion system according to a preferred embodiment of the present invention, the main propulsion device is preferably provided on a centerline of the hull in the right-left direction, and the auxiliary propulsion device is preferably provided to one side of the centerline of the hull in the right-left direction. Accordingly, it is not necessary to drive both of the propulsion devices that have different maximum outputs and are asymmetrical to each other in the right-left direction of the hull in the control to rotate the hull, and thus the control by the controller to rotate the hull is effectively prevented from being complex.

In such a case, the controller is preferably configured or programmed to control an output of the auxiliary propulsion device and a rudder angle of the auxiliary propulsion device such that a rotational moment to rotate the hull counterclockwise is equal or substantially equal to a rotational moment to rotate the hull clockwise. Accordingly, even when the auxiliary propulsion device is provided to one side of the centerline of the hull in the right-left direction, the rotational moment to rotate the hull counterclockwise and the rotational moment to rotate the hull clockwise are equalized such that the rotating speed of the hull at the time of rotating the hull counterclockwise and the rotating speed of the hull at the time of rotating the hull clockwise are equalized or substantially equalized. Consequently, even when the auxiliary propulsion device is provided to one side of the centerline of the hull in the right-left direction, the hull is rotated without reducing the maneuverability.

In a marine propulsion system including the controller configured or programmed to control the output of the auxiliary propulsion device and the rudder angle of the auxiliary propulsion device such that the rotational moment to rotate the hull counterclockwise is equal or substantially equal to the rotational moment to rotate the hull clockwise, the controller is preferably configured or programmed to perform a control to make the output and the rudder angle of the auxiliary propulsion device to rotate the hull counterclockwise different from the output and the rudder angle of the auxiliary propulsion device to rotate the hull clockwise such that the rotational moment to rotate the hull counterclockwise is equal or substantially equal to the rotational moment to rotate the hull clockwise. Accordingly, the output of the auxiliary propulsion device and the rudder angle of the auxiliary propulsion device are easily controlled such that the rotational moment to rotate the hull counterclockwise is equal or substantially equal to the rotational moment to rotate the hull clockwise.

In a marine propulsion system including the main propulsion device provided on the centerline of the hull in the right-left direction, and the auxiliary propulsion device provided to one side of the centerline of the hull in the right-left direction, the controller is preferably configured or programmed to perform a control to rotate the hull by driving the auxiliary propulsion device without generating the thrust from the main propulsion device and with a rudder angle of the main propulsion device changed to a same side in the right-left direction as a rudder angle of the auxiliary propulsion device. Accordingly, the hull is rotated while the direction of the thrust of the auxiliary propulsion device and the orientation of a portion of the main propulsion device located in the water are relatively aligned with each other, and thus a resistance generated in the portion of the main propulsion device located in the water when the hull is rotated is reduced or prevented. Consequently, the hull is rotated smoothly.

In such a case, the controller is preferably configured or programmed to perform a control to rotate the hull by driving the auxiliary propulsion device without generating the thrust from the main propulsion device and with the rudder angle of the main propulsion device changed to the same side in the right-left direction as the rudder angle of the auxiliary propulsion device up to an end of the steering angle range of the main propulsion device. Accordingly, the rudder angle of the main propulsion device is aligned with the rudder angle of the auxiliary propulsion device as much as possible, and thus a resistance generated by the portion of the main propulsion device located in the water when the hull is rotated is further reduced or prevented. Consequently, the hull is rotated more smoothly.

In a marine propulsion system according to a preferred embodiment of the present invention, the auxiliary propulsion device preferably has a maximum value of a power range when generating a thrust for forward movement larger than that when generating a thrust for rearward movement, and the controller is preferably configured or programmed to perform a control to rotate the hull by driving the auxiliary propulsion device to generate the thrust for forward movement. Accordingly, as compared with a case in which the auxiliary propulsion device is driven to generate a thrust for rearward movement, the rotational moment to rotate the hull is increased to improve the rotating speed of the hull.

In a marine propulsion system according to a preferred embodiment of the present invention, the steering angle range of the auxiliary propulsion device is preferably about 60 degrees or more and about 80 degrees or less in each of clockwise and counterclockwise directions. Accordingly, the auxiliary propulsion device is steered to a rudder angle sufficient for only the auxiliary propulsion device to rotate the hull, and thus a structure in which the hull is rotated by driving the auxiliary propulsion device without generating a thrust from the main propulsion device is easily achieved.

In a marine propulsion system according to a preferred embodiment of the present invention, the controller is preferably configured or programmed to perform a control to rotate the hull by driving the auxiliary propulsion device when a joystick corresponding to an operator to operate the hull is rotated. Accordingly, the operating direction (rotating direction) of the joystick is the same as the moving direction (rotating direction) of the hull, and thus the joystick is operated in an intuitively easy-to-understand state to rotate the hull.

In a marine propulsion system according to a preferred embodiment of the present invention, the main propulsion device is preferably an engine outboard motor including an engine to drive a main propeller corresponding to a main thruster that generates the thrust and provided on a centerline of the hull in the right-left direction, and the auxiliary propulsion device is preferably an electric outboard motor including the electric motor to drive an auxiliary propeller corresponding to the auxiliary thruster and provided to one side of the centerline of the hull in the right-left direction. Accordingly, in a structure including a plurality of propulsion devices having different maximum outputs, the main propulsion device of which is an engine outboard motor provided on the centerline of the hull in the right-left direction and the auxiliary propulsion device of which is an electric outboard motor provided to one side of the centerline of the hull in the right-left direction, the hull is rotated while the control by the controller is prevented from being complex.

A marine propulsion system according to a preferred embodiment of the present invention includes a main propulsion device to be attached to a stern of a hull and operable to rotate in a right-left direction to change a direction of a thrust, an auxiliary propulsion device to be attached to the stern, operable to rotate in the right-left direction to change a direction of a thrust, having a maximum output smaller than a maximum output of the main propulsion device, and having a steering angle range wider than a steering angle range of the main propulsion device, and a controller configured or programmed to perform a control to rotate the hull by driving the auxiliary propulsion device without generating the thrust from the main propulsion device.

In a marine propulsion system according to a preferred embodiment of the present invention, the controller is configured or programmed to perform a control to rotate the hull by driving the auxiliary propulsion device having a maximum output smaller than a maximum output of the main propulsion device and having a steering angle range wider than a steering angle range of the main propulsion device without generating the thrust from the main propulsion device. Accordingly, similarly to the marine propulsion systems according to preferred embodiments of the present invention described above, in a structure including a plurality of propulsion devices having different maximum outputs, the hull is rotated while the control by the controller is prevented from being complex.

A marine vessel according to a preferred embodiment of the present invention includes a hull, and a marine propulsion system provided on or in the hull. The marine propulsion system includes a main propulsion device attached to a stern of the hull and operable to rotate in a right-left direction to change a direction of a thrust, an auxiliary propulsion device attached to the stern, including an electric motor to drive an auxiliary thruster to generate a thrust, operable to rotate in the right-left direction to change a direction of the thrust, having a maximum output smaller than a maximum output of the main propulsion device, and having a steering angle range wider than a steering angle range of the main propulsion device, and a controller configured or programmed to perform a control to rotate the hull by driving the auxiliary propulsion device without generating the thrust from the main propulsion device.

In a marine vessel according to a preferred embodiment of the present invention, the controller is configured or programmed to perform a control to rotate the hull by driving the auxiliary propulsion device having a maximum output smaller than a maximum output of the main propulsion device and having a steering angle range wider than a steering angle range of the main propulsion device without generating the thrust from the main propulsion device. Accordingly, similarly to the marine propulsion systems according to preferred embodiments of the present invention described above, in a structure including a plurality of propulsion devices having different maximum outputs, the hull is rotated while the control by the controller is prevented from being complex.

In a marine vessel according to a preferred embodiment of the present invention, the controller is configured or programmed to perform a control to rotate the hull by driving the auxiliary propulsion device including the electric motor to drive the auxiliary thruster to generate a thrust without generating a thrust from the main propulsion device. Accordingly, similarly to the marine propulsion systems according to preferred embodiments of the present invention described above, as compared with a case in which the auxiliary propulsion device including the electric motor is not used when the hull is rotated, from the viewpoint of SDGs, a preferable device structure is achieved.

In a marine vessel according to a preferred embodiment of the present invention, the main propulsion device is preferably provided on a centerline of the hull in the right-left direction, and the auxiliary propulsion device is preferably provided to one side of the centerline of the hull in the right-left direction. Accordingly, similarly to the marine propulsion systems according to preferred embodiments of the present invention described above, the control by the controller to rotate the hull is effectively prevented from being complex.

In such a case, the controller is preferably configured or programmed to control an output of the auxiliary propulsion device and a rudder angle of the auxiliary propulsion device such that a rotational moment to rotate the hull counterclockwise is equal or substantially equal to a rotational moment to rotate the hull clockwise. Accordingly, similarly to the marine propulsion systems according to preferred embodiments of the present invention described above, even when the auxiliary propulsion device is provided to one side of the centerline of the hull in the right-left direction, the hull is rotated without reducing the maneuverability.

In a marine vessel including the controller configured or programmed to control the output of the auxiliary propulsion device and the rudder angle of the auxiliary propulsion device such that the rotational moment to rotate the hull counterclockwise is equal or substantially equal to the rotational moment to rotate the hull clockwise, the controller is preferably configured or programmed to perform a control to make the output and the rudder angle of the auxiliary propulsion device to rotate the hull counterclockwise different from the output and the rudder angle of the auxiliary propulsion device to rotate the hull clockwise such that the rotational moment to rotate the hull counterclockwise is equal or substantially equal to the rotational moment to rotate the hull clockwise. Accordingly, similarly to the marine propulsion systems according to preferred embodiments of the present invention described above, the output of the auxiliary propulsion device and the rudder angle of the auxiliary propulsion device are easily controlled such that the rotational moment to rotate the hull counterclockwise is equal or substantially equal to the rotational moment to rotate the hull clockwise.

In a marine vessel including the main propulsion device provided on the centerline of the hull in the right-left direction, and the auxiliary propulsion device provided to one side of the centerline of the hull in the right-left direction, the controller is preferably configured or programmed to perform a control to rotate the hull by driving the auxiliary propulsion device without generating the thrust from the main propulsion device and with a rudder angle of the main propulsion device changed to a same side in the right-left direction as a rudder angle of the auxiliary propulsion device. Accordingly, similarly to the marine propulsion systems according to preferred embodiments of the present invention described above, the hull is rotated smoothly.

In such a case, the controller is preferably configured or programmed to perform a control to rotate the hull by driving the auxiliary propulsion device without generating the thrust from the main propulsion device and with the rudder angle of the main propulsion device changed to the same side in the right-left direction as the rudder angle of the auxiliary propulsion device up to an end of the steering angle range of the main propulsion device. Accordingly, similarly to the marine propulsion systems according to preferred embodiments of the present invention described above, the hull is rotated more smoothly.

In a marine vessel according to a preferred embodiment of the present invention, the auxiliary propulsion device preferably has a maximum value of a power range when generating a thrust for forward movement larger than a maximum value of a power range when generating a thrust for rearward movement, and the controller is preferably configured or programmed to perform a control to rotate the hull by driving the auxiliary propulsion device to generate the thrust for forward movement. Accordingly, similarly to the marine propulsion systems according to preferred embodiments of the present invention described above, as compared with a case in which the auxiliary propulsion device is driven to generate a thrust for rearward movement, the rotational moment to rotate the hull is increased to improve the rotating speed of the hull.

In a marine vessel according to a preferred embodiment of the present invention, the steering angle range of the auxiliary propulsion device is preferably about 60 degrees or more and about 80 degrees or less in each of clockwise and counterclockwise directions. Accordingly, similarly to the marine propulsion systems according to preferred embodiments of the present invention described above, a structure in which the hull is rotated by driving the auxiliary propulsion device without generating a thrust from the main propulsion device is easily achieved.

In a marine vessel according to a preferred embodiment of the present invention, the controller is preferably configured or programmed to perform a control to rotate the hull by driving the auxiliary propulsion device when a joystick corresponding to an operator to operate the hull is rotated. Accordingly, similarly to the marine propulsion systems according to preferred embodiments of the present invention described above, the joystick is operated in an intuitively easy-to-understand state to rotate the hull.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structures of a marine propulsion system 100 and a marine vessel 110 according to preferred embodiments of the present invention are now described with reference to FIGS. 1 to 8. In the figures, arrow FWD represents the front of the marine vessel 110, arrow BWD represents the rear of the marine vessel 110, arrow L represents the left (port side) of the marine vessel 110, and arrow R represents the right (starboard side) of the marine vessel 110.

Figure 1:
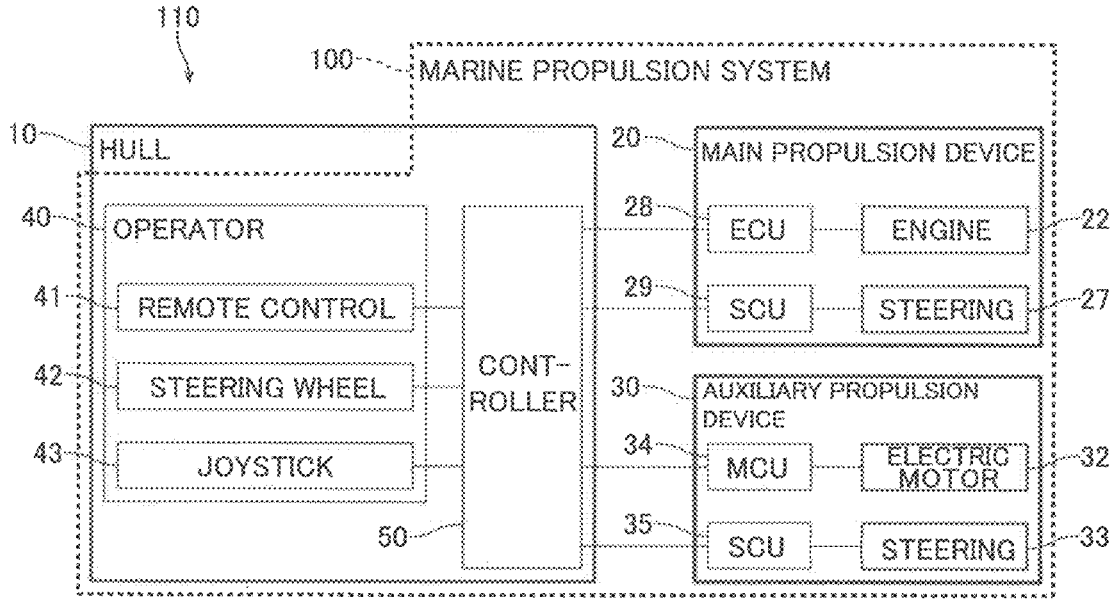
FIG. 1 is a block diagram showing a marine propulsion system according to a preferred embodiment of the present invention.

As shown in FIG. 1, the marine vessel 110 includes a hull 10 and the marine propulsion system 100. The marine propulsion system 100 is provided on or in the hull 10. The marine propulsion system 100 propels the marine vessel 110. The marine vessel 110 may be a relatively small marine vessel used for sightseeing or fishing, for example.

The marine propulsion system 100 includes a main propulsion device 20, an auxiliary propulsion device 30, an operator 40, and a controller 50. The operator 40 and the controller 50 are provided on and in the hull 10.

Figure 2:
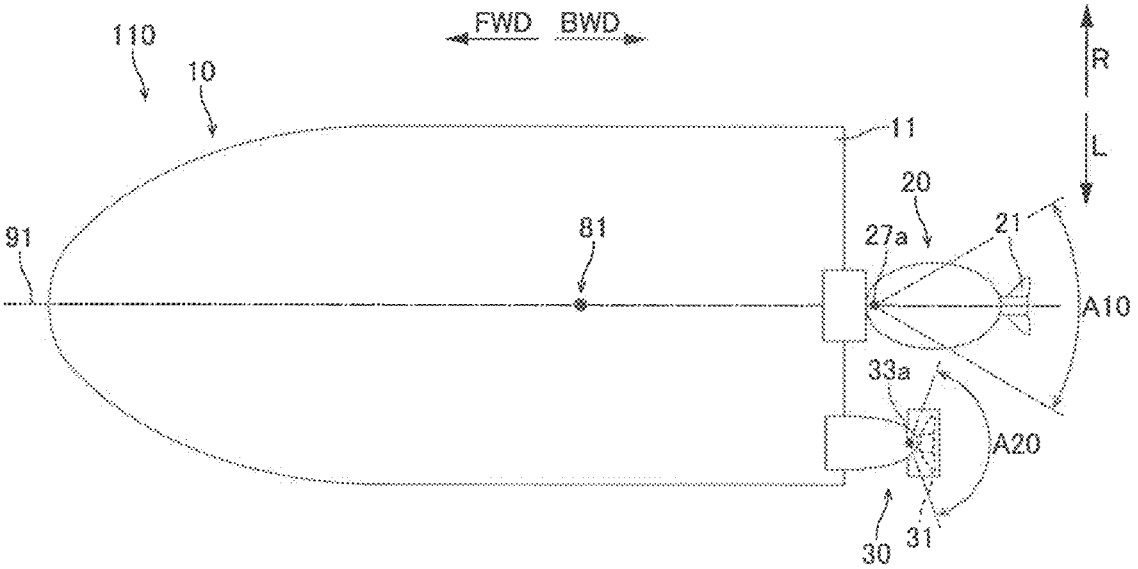
FIG. 2 is a schematic view showing a marine vessel according to a preferred embodiment of the present invention.

As shown in FIG. 2, only one main propulsion device 20 is attached to a stern 11 of the hull 10. The main propulsion device 20 is located on a centerline 91 of the hull 10 in a right-left direction.

Figure 3:
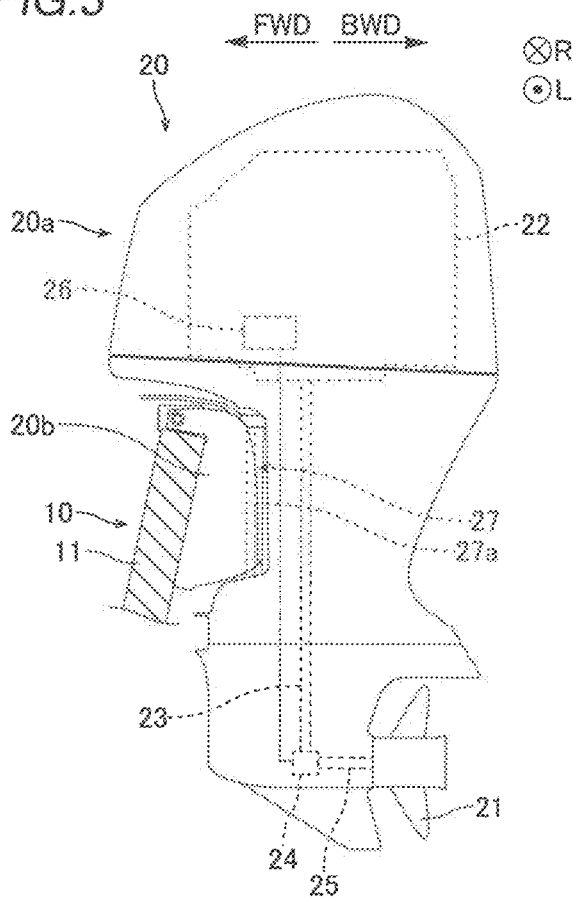
FIG. 3 is a side view showing a main propulsion device of a marine vessel according to a preferred embodiment of the present invention.

As shown in FIG. 3, the main propulsion device 20 includes a main propulsion device main body 20*a* and a bracket 20*b*. The main propulsion device main body 20*a* is attached to the stern 11 of the hull 10 via the bracket 20*b*.

The main propulsion device 20 is an engine outboard motor including an engine 22 to drive a main propeller 21 that generates a thrust. Specifically, the main propulsion device main body 20*a* includes the engine 22, a drive shaft 23, a gearing 24, a propeller shaft 25, and the main propeller 21. The engine 22 is an internal combustion engine that generates a driving force. The driving force of the engine 22 is transmitted to the main propeller 21 via the drive shaft 23, the gearing 24, and the propeller shaft 25. The main propeller 21 generates a thrust by rotating in the water by the driving force transmitted from the engine 22.

The main propulsion device main body 20*a* includes a shift actuator 26 that switches the shift state of the main propulsion device 20. The shift actuator 26 switches the shift state of the main propulsion device 20 between a forward movement state, a rearward movement state, and a neutral state by switching the meshing of the gearing 24. In the forward movement state, a driving force is transmitted from the engine 22 to the main propeller 21 to generate a forward thrust from the main propeller 21. In the rearward movement state, a driving force is transmitted from the engine 22 to the main propeller 21 to generate a rearward thrust from the main propeller 21. In the neutral state, a driving force is not transmitted from the engine 22 to the main propeller 21 in order to not generate a thrust in the main propeller 21. In the main propulsion device 20, when the shift state of the main propulsion device 20 is switched, the gearing 24 generates relatively loud noises and vibrations.

The main propulsion device 20 rotates in the right-left direction to change the direction of a thrust. Specifically, a steering 27 is provided on the bracket 20*b*. The steering 27 includes a steering shaft 27*a* that extends in an upward-downward direction. The main propulsion device main body 20*a* is rotated in the right-left direction by the steering 27 about the steering shaft 27*a* with respect to the bracket 20*b*. When the main propulsion device main body 20*a* rotates in the right-left direction about the steering shaft 27*a*, the orientation of the main propeller 21 also rotates in the right-left direction. Thus, the direction of the thrust of the main propeller 21 is changed. In the following description, changing the direction of the thrust of the main propeller 21 by rotating the orientation of the main propeller 21 in the right-left direction is referred to as "steering the main propulsion device 20".

As shown in FIG. 2, the main propulsion device 20 is steerable by about 30 degrees to each of the L side and the R side. That is, a steering angle range A10, which is an angular range in which the main propulsion device 20 is steerable, is about 60 degrees.

As shown in FIG. 1, the main propulsion device 20 includes an engine control unit (ECU) 28 and a steering control unit (SCU) 29. The ECU 28 controls driving of the engine 22 and driving of the shift actuator 26 based on control by the controller 50. The SCU 29 controls driving of the steering 27 based on control by the controller 50. The ECU 28 and the SCU 29 include a control circuit including a central processing unit (CPU), for example.

As shown in FIG. 2, only one auxiliary propulsion device 30 is attached to the stern 11 of the hull 10. The auxiliary propulsion device 30 is provided to one side of the centerline of the hull 10 in the right-left direction. In the marine propulsion system 100, the auxiliary propulsion device 30 is provided to the L side of the hull 10.

Figure 4:
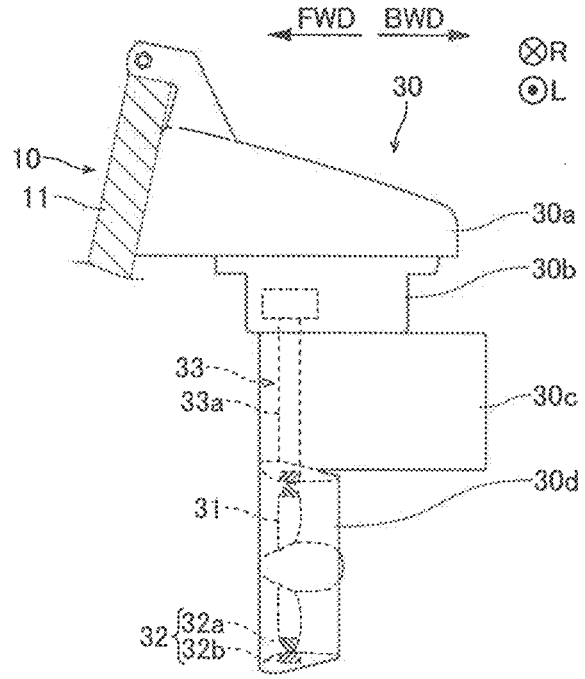
FIG. 4 is a side view showing an auxiliary propulsion device of a marine vessel according to a preferred embodiment of the present invention.

As shown in FIG. 4, the auxiliary propulsion device 30 includes a cowling 30*a*, an upper case 30*b*, a lower case 30*c*, and a duct 30*d*. The cowling 30*a*, the upper case 30*b*, the lower case 30*c*, and the duct 30*d* are aligned in this order from top to bottom. The cowling 30*a* is attached to the stern 11 of the hull 10.

The auxiliary propulsion device 30 is an electric outboard motor including an electric motor 32 to drive an auxiliary propeller 31 that generates a thrust. Specifically, the auxiliary propulsion device 30 includes the electric motor 32 and the auxiliary propeller 31. The electric motor 32 is provided in the duct 30*d*. The auxiliary propeller 31 is provided in the duct 30*d*. The electric motor 32 is driven by power from a battery (not shown) provided on the hull 10. The electric motor 32 includes a stator 32*a* that is integral and unitary with the duct 30*d*, and a rotor 32*b* that is integral and unitary with the auxiliary propeller 31. The auxiliary propeller 31 generates a thrust by rotating in the water by a driving force transmitted from the electric motor 32. The auxiliary propeller 31 is an example of an "auxiliary thruster".

When the auxiliary propeller 31 is rotated forward, a forward thrust is generated from the auxiliary propeller 31. When the auxiliary propeller 31 is rotated backward, a rearward thrust is generated from the auxiliary propeller 31. When the auxiliary propeller 31 is stopped, a thrust is not generated from the auxiliary propeller 31. That is, in the auxiliary propulsion device 30, it is not necessary to switch the meshing of the gearing 24 (see FIG. 3) unlike the main propeller 21 (see FIG. 3) of the main propulsion device 20 (see FIG. 3). Thus, the auxiliary propulsion device 30 does not generate relatively loud noises or vibrations unlike the main propulsion device 20.

The auxiliary propulsion device 30 rotates in the right-left direction to change the direction of a thrust. Specifically, a steering 33 is provided in the auxiliary propulsion device 30. The steering 33 includes a steering shaft 33*a* fixed to the lower case 30*c* and extending in the upward-downward direction. An upper end of the steering shaft 33*a* is located in the upper case 30*b*. A lower end of the steering shaft 33*a* is fixed to the duct 30*d*. The duct 30*d* and the lower case 30*c* are rotatable in the right-left direction by the steering 33 about the steering shaft 33*a* with respect to the cowling 30*a* and the upper case 30*b*. When the duct 30*d* rotates in the right-left direction about the steering shaft 33*a*, the orientation of the auxiliary propeller 31 also rotates in the right-left direction. Thus, the direction of the thrust of the auxiliary propeller 31 is changed. In the following description, changing the direction of the thrust of the auxiliary propeller 31 by rotating the orientation of the auxiliary propeller 31 in the right-left direction is referred to as "steering the auxiliary propulsion device 30".

As shown in FIG. 2, the steering angle range of the auxiliary propulsion device 30 is wider than that of the main propulsion device 20. The steering angle range of the auxiliary propulsion device 30 is about 60 degrees or more and about 80 degrees or less in each of clockwise and counterclockwise directions. FIG. 2 shows an example in which the auxiliary propulsion device 30 is steerable by about 70 degrees to each of the L side and the R side. That is, FIG. 2 shows an example in which a steering angle range A20, which is an angular range in which the auxiliary propulsion device 30 is steerable, is about 140 degrees.

As shown in FIG. 1, the auxiliary propulsion device 30 includes a motor control unit (MCU) 34 and a steering control unit (SCU) 35. The MCU 34 and the SCU 35 include a control circuit including a CPU, for example. The MCU 34 controls driving of the electric motor 32 based on control by the controller 50. The SCU 35 controls driving of the steering 33 based on control by the controller 50.

Figure 5:
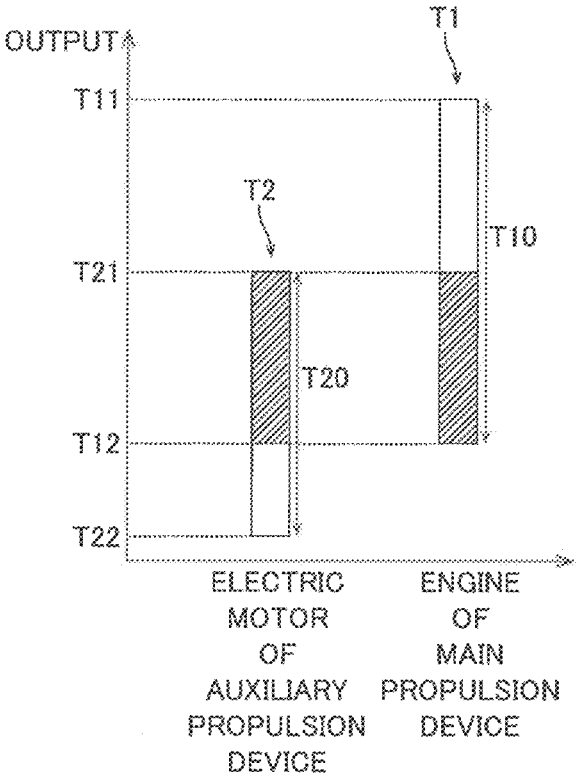
FIG. 5 is a diagram showing a power range of an engine of a main propulsion device and a power range of an electric motor of an auxiliary propulsion device according to a preferred embodiment of the present invention.

As shown in FIG. 5, the maximum output of the auxiliary propulsion device 30 is smaller than that of the main propulsion device 20. Specifically, the maximum value T11 and the minimum value T12 of the power range T10 of the engine 22 of the main propulsion device 20 are larger than the maximum value T21 and the minimum value T22 of the power range T20 of the electric motor 32 of the auxiliary propulsion device 30, respectively. The minimum value T12 of the power range T10 of the engine 22 is smaller than the maximum value T21 of the power range T20 of the electric motor 32. That is, the power range T10 of the engine 22 of the main propulsion device 20 and the power range T20 of the electric motor 32 of the auxiliary propulsion device 30 overlap each other between the maximum value T21 of the power range T20 of the electric motor 32 and the minimum value T12 of the power range T10 of the engine 22. In the auxiliary propulsion device 30, the maximum value T21 of the power range T20 at the time of generating a thrust for forward movement is larger than the maximum value T21 of the power range T20 at the time of generating a thrust for rearward movement.

As shown in FIG. 1, the operator 40 receives a user's operation in order to operate (maneuver) the hull 10. The operator 40 includes a remote control 41, a steering wheel 42, and a joystick 43.

The remote control 41 includes a lever. The steering wheel 42 is rotatable. The hull 10 is operated by combining an operation on the lever of the remote control 41 and an operation to rotate the steering wheel 42.

Figure 6:
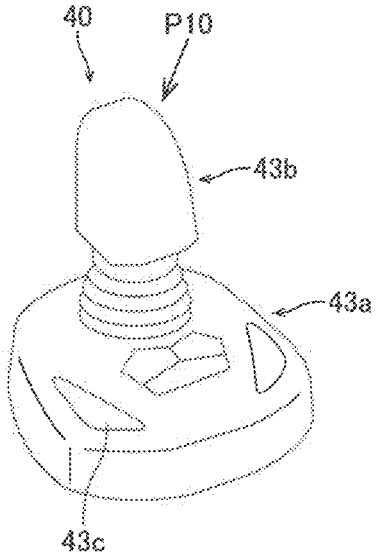
FIG. 6 is a diagram showing a joystick of a marine vessel according to a preferred embodiment of the present invention.

As shown in FIG. 6, the joystick 43 includes a base 43*a* and a lever 43*b*. The lever 43*b* is tiltably and rotatably attached to the base 43*a*. The lever 43*b* is urged by an urging member such as a spring to automatically return to a neutral position P10 when not operated by the user. At the neutral position P10, the lever 43*b* is upright and is not rotated.

Operations on the joystick 43 are roughly divided into three operations: an operation to tilt the lever 43*b*, an operation to tilt and rotate the lever 43*b*, and an operation to rotate the lever 43*b*. The operation to tilt the lever 43*b* corresponds to an operation to translate the hull 10 (see FIG. 1). The translation includes forward and rearward movements, lateral movements, and diagonal movements. The operation to tilt and rotate the lever 43*b* corresponds to an operation to turn the hull 10. The turning includes clockwise turning and counterclockwise turning. The operation to rotate the lever 43*b* corresponds to an operation to rotate the hull 10. In the following description, for convenience of explanation, "rotating the lever 43*b*" is referred to as "rotating the joystick 43".

A joystick mode switch 43*c* is provided on the base 43*a* of the joystick 43. In the marine propulsion system 100, the joystick mode switch 43*c* is pressed to switch between a state in which the controller 50 controls driving of the main propulsion device 20 and driving of the auxiliary propulsion device 30 based on an operation on the joystick 43 (joystick mode) and a state in which the controller 50 controls driving of the main propulsion device 20 and driving of the auxiliary propulsion device 30 based on operations on the remote control 41 and the steering wheel 42 (non-joystick mode). When the marine propulsion system 100 is in the joystick mode, operations on the remote control 41 and the steering wheel 42 are not received. When the marine propulsion system 100 is in the non-joystick mode, an operation on the joystick 43 is not received.

As shown in FIG. 1, the controller 50 controls the ECU 28 of the main propulsion device 20, the SCU 29 of the main propulsion device 20, the MCU 34 of the auxiliary propulsion device 30, and the SCU 29 of the auxiliary propulsion device 30 based on an operation on the operator 40. The controller 50 includes a control circuit including a CPU, for example.

Figure 7:
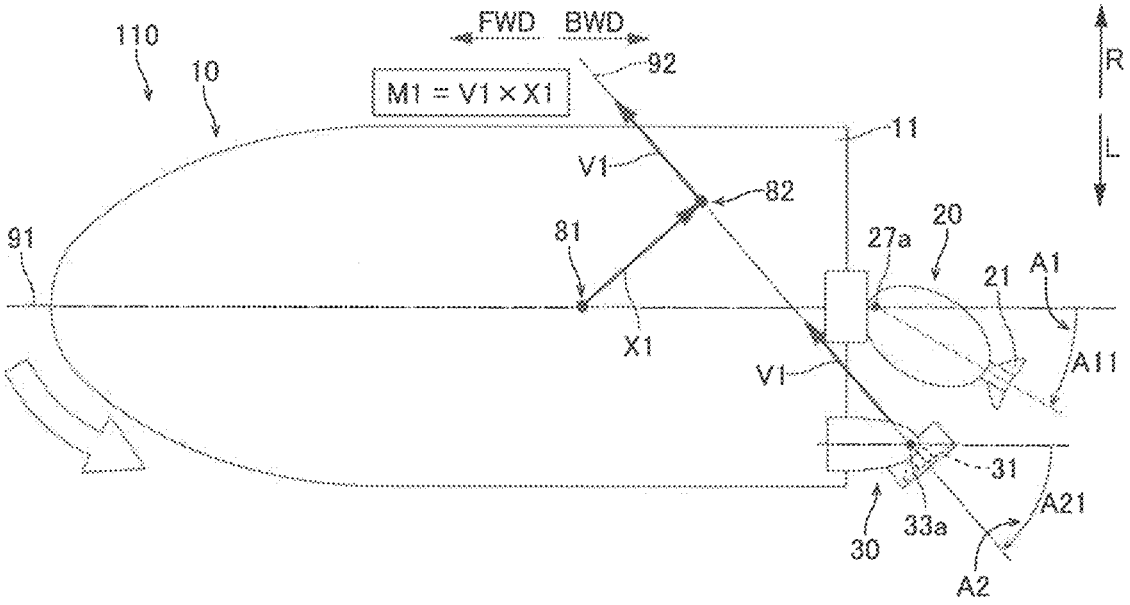
FIG. 7 is a schematic view showing lateral movement of a hull of a marine vessel according to a preferred embodiment of the present invention.
Figure 8:
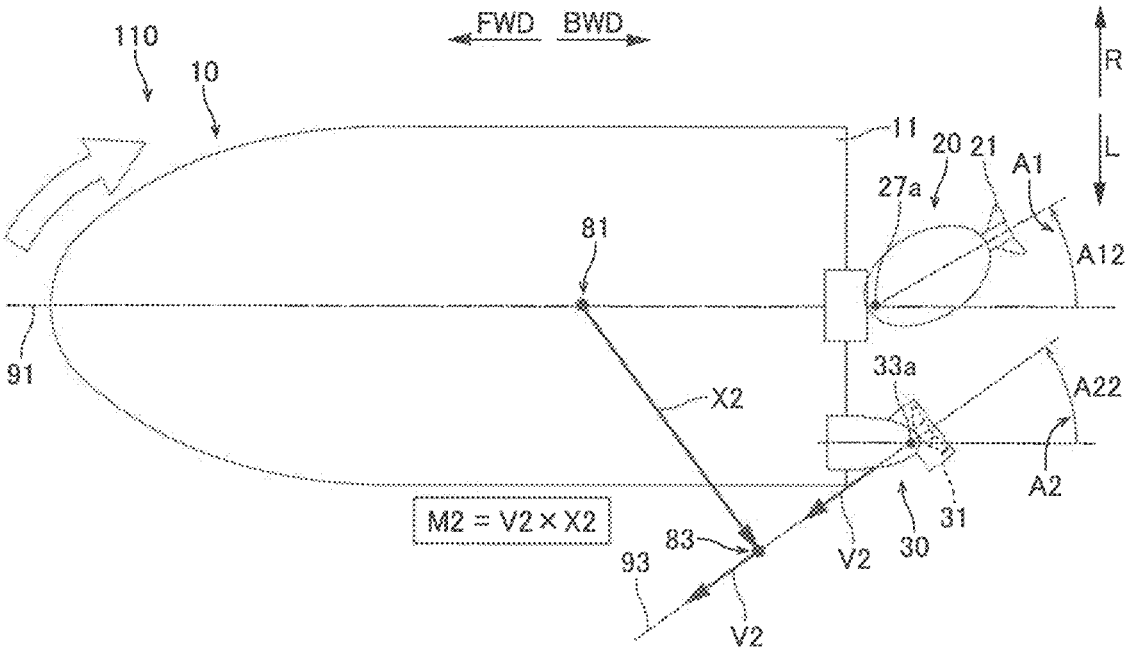
FIG. 8 is a schematic view showing diagonal movement of a hull of a marine vessel according to a preferred embodiment of the present invention.

As shown in FIGS. 7 and 8, the controller 50 (see FIG. 1) performs a control to rotate the hull 10 by driving the auxiliary propulsion device 30 having a steering angle range wider than that of the main propulsion device 20 without generating a thrust from the main propulsion device 20. When the joystick 43 is rotated, the controller 50 performs a control to rotate the hull 10 by driving the auxiliary propulsion device 30.

Specifically, when the marine propulsion system 100 is in the joystick mode and the joystick 43 (see FIG. 1) is rotated, the controller 50 (see FIG. 1) controls the output T2 and the rudder angle A2 of the auxiliary propulsion device 30 such that the hull 10 is rotated in a direction (counterclockwise or clockwise) corresponding to the rotating direction of the joystick 43 and at a rotating speed corresponding to the amount of rotation of the joystick 43. FIG. 7 shows an example in which the rudder angle A1 of the main propulsion device 20 and the rudder angle A2 of the auxiliary propulsion device 30 are A11 and A21, respectively. FIG. 8 shows an example in which the rudder angle A1 of the main propulsion device 20 and the rudder angle A2 of the auxiliary propulsion device 30 are A12 and A22, respectively. Al2 is equal (in magnitude) to A11, as described below. A22 may be equal to or different from A21.

The controller 50 (see FIG. 1) performs a control to rotate the hull 10 by driving the auxiliary propulsion devices 30 to generate a thrust for forward movement from the auxiliary propulsion device 30.

As shown in FIGS. 7 and 8, the controller 50 (see FIG. 1) controls the output T2 (see FIG. 5) of the auxiliary propulsion device 30 and the rudder angle A2 of the auxiliary propulsion device 30 such that the rotational moment to rotate the hull 10 counterclockwise is equal or substantially equal to the rotational moment to rotate the hull 10 clockwise. Specifically, the controller 50 performs a control to make the output T2 and the rudder angle A2 of the auxiliary propulsion device 30 to rotate the hull 10 counterclockwise different from the output T2 and the rudder angle A2 of the auxiliary propulsion device 30 to rotate the hull 10 clockwise such that the rotational moment to rotate the hull 10 counterclockwise is equal or substantially equal to the rotational moment to rotate the hull 10 clockwise.

More specifically, as shown in FIG. 7, when the hull 10 is rotated counterclockwise, the controller 50 (see FIG. 1) controls the auxiliary propulsion device 30 to steer to the L side and generate the output T2 (see FIG. 5) to the FWD side. The cross product (vector product) of the output vector V1 of the auxiliary propulsion device 30 and the position vector X1 from the center of gravity 81 of the hull 10 to the point of action 92 of the output vector V1 becomes the rotational moment M1 to rotate the hull 10 counterclockwise. As shown in FIG. 8, when the hull 10 is rotated clockwise, the controller 50 controls the auxiliary propulsion device 30 to steer to the R side and generate the output T2 to the FWD side. The cross product (vector product) of the output vector V2 of the auxiliary propulsion device 30 and the position vector X2 from the center of gravity 81 of the hull 10 to the point of action 93 of the output vector V2 becomes the rotational moment M2 to rotate the hull 10 clockwise. When the amount of counterclockwise rotation of the joystick 43 to rotate the hull 10 counterclockwise is equal or substantially equal to the amount of clockwise rotation of the joystick 43 to rotate the hull 10 clockwise, the rotational moment M1 is equal or substantially equal to the rotational moment M2.

As shown in FIGS. 7 and 8, the controller 50 (see FIG. 1) performs a control to rotate the hull 10 by driving the auxiliary propulsion device 30 without generating a thrust from the main propulsion device 20 with the rudder angle A1 of the main propulsion device 20 changed to the same side in the right-left direction as the rudder angle A2 of the auxiliary propulsion device 30 up to the end of the steering angle range A10 (see FIG. 2) of the main propulsion device 20. Specifically, as shown in FIG. 7, when the hull 10 is rotated counterclockwise, the controller 50 controls the auxiliary propulsion device 30 to steer the auxiliary propulsion device 30 to the L side and controls the main propulsion device 20 to steer the main propulsion device 20 to the L side by about 30 degrees. As shown in FIG. 8, when the hull 10 is rotated clockwise, the controller 50 controls the auxiliary propulsion device 30 to steer the auxiliary propulsion device 30 to the R side and controls the main propulsion device 20 to steer the main propulsion device 20 to the R side by about 30 degrees. That is, the rudder angle A1 (A11 (see FIG. 7)) of the main propulsion device 20 obtained when the hull 10 is rotated counterclockwise and the rudder angle A2 (A12) of the main propulsion device 20 obtained when the hull 10 is rotated clockwise are equal to each other in magnitude.

According to the various preferred embodiments of the present invention described above, the following advantageous effects are achieved.

According to a preferred embodiment of the present invention, the controller 50 is configured or programmed to perform a control to rotate the hull 10 by driving the auxiliary propulsion device 30 having a maximum output smaller than that of the main propulsion device 20 and a steering angle range wider than that of the main propulsion device 20 without generating a thrust from the main propulsion device 20. Accordingly, although the main propulsion device 20 and the auxiliary propulsion device 30 have different maximum outputs, the auxiliary propulsion device 30 is driven without generating a thrust from the main propulsion device 20 in the control to rotate the hull 10, and thus as compared with a case in which a thrust is generated from the main propulsion device 20 and the auxiliary propulsion device 30 is driven, the control by the controller 50 to rotate the hull 10 is prevented from being complex. Furthermore, the auxiliary propulsion device 30 has a steering angle range wider than that of the main propulsion device 20, and thus even when a thrust is not generated from the main propulsion device 20, the hull 10 is easily rotated by driving the auxiliary propulsion device 30. Consequently, in a structure including a plurality of propulsion devices having different maximum outputs, the hull 10 is rotated while the control by the controller 50 is prevented from being complex.

According to a preferred embodiment of the present invention, the controller 50 is configured or programmed to perform a control to rotate the hull 10 by driving the auxiliary propulsion device 30 including the electric motor 32 to drive the auxiliary propeller 31 that generates a thrust without generating a thrust from the main propulsion device 20. Accordingly, unlike the engine 22, the electric motor 32 does not directly emit carbon dioxide, and thus as compared with a case in which the auxiliary propulsion device 30 including the electric motor 32 is not used when the hull 10 is rotated, from the viewpoint of SDGs, a preferable device structure is achieved.

According to a preferred embodiment of the present invention, the main propulsion device 20 is provided on the centerline 91 of the hull 10 in the right-left direction. Furthermore, the auxiliary propulsion device 30 is provided to one side of the centerline of the hull 10 in the right-left direction. Accordingly, it is not necessary to drive both of the propulsion devices that have different maximum outputs and are asymmetrical to each other in the right-left direction of the hull in the control to rotate the hull 10, and thus the control by the controller 50 to rotate the hull 10 is effectively prevented from being complex.

According to a preferred embodiment of the present invention, the controller 50 is configured or programmed to control the output T1 of the auxiliary propulsion device 30 and the rudder angle A2 of the auxiliary propulsion device 30 such that the rotational moment to rotate the hull 10 counterclockwise is equal or substantially equal to the rotational moment to rotate the hull 10 clockwise. Accordingly, even when the auxiliary propulsion device 30 is provided to one side of the centerline of the hull 10 in the right-left direction, the rotational moment M1 to rotate the hull 10 counterclockwise and the rotational moment M2 to rotate the hull 10 clockwise are equalized such that the rotating speed of the hull 10 at the time of rotating the hull 10 counterclockwise and the rotating speed of the hull 10 at the time of rotating the hull 10 clockwise are equalized or substantially equalized. Consequently, even when the auxiliary propulsion device 30 is provided to one side of the centerline of the hull 10 in the right-left direction, the hull 10 is rotated without reducing the maneuverability.

According to a preferred embodiment of the present invention, the controller 50 is configured or programmed to perform a control to make the output T1 and the rudder angle A2 of the auxiliary propulsion device 30 to rotate the hull 10 counterclockwise different from the output T1 and the rudder angle A2 of the auxiliary propulsion device 30 to rotate the hull 10 clockwise such that the rotational moment to rotate the hull 10 counterclockwise is equal or substantially equal to the rotational moment to rotate the hull 10 clockwise. Accordingly, the output T1 of the auxiliary propulsion device 30 and the rudder angle A2 of the auxiliary propulsion device 30 are easily controlled such that the rotational moment to rotate the hull 10 counterclockwise is equal or substantially equal to the rotational moment to rotate the hull 10 clockwise.

According to a preferred embodiment of the present invention, the controller 50 is configured or programmed to perform a control to rotate the hull 10 by driving the auxiliary propulsion device 30 without generating a thrust from the main propulsion device 20 and with the rudder angle A1 of the main propulsion device 20 changed to the same side in the right-left direction as the rudder angle A2 of the auxiliary propulsion device 30. Accordingly, the hull 10 is rotated while the direction of the thrust of the auxiliary propulsion device 30 and the orientation of a portion of the main propulsion device 20 located in the water are relatively aligned with each other, and thus a resistance generated in the portion of the main propulsion device 20 located in the water when the hull 10 is rotated is reduced or prevented. Consequently, the hull 10 is rotated smoothly.

According to a preferred embodiment of the present invention, the controller 50 is configured or programmed to perform a control to rotate the hull 10 by driving the auxiliary propulsion device 30 without generating a thrust from the main propulsion device 20 and with the rudder angle A1 of the main propulsion device 20 changed to the same side in the right-left direction as the rudder angle A2 of the auxiliary propulsion device 30 up to the end of the steering angle range A10 of the main propulsion device 20. Accordingly, the rudder angle A1 of the main propulsion device 20 is aligned with the rudder angle A2 of the auxiliary propulsion device 30 as much as possible, and thus a resistance generated in the portion of the main propulsion device 20 located in the water when the hull 10 is rotated is further reduced or prevented. Consequently, the hull 10 is rotated more smoothly.

According to a preferred embodiment of the present invention, the auxiliary propulsion device 30 has the maximum value T21 of the power range T20 when generating a thrust for forward movement larger than that when generating a thrust for rearward movement. Furthermore, the controller 50 is configured or programmed to perform a control to rotate the hull 10 by driving the auxiliary propulsion device 30 to generate a thrust for forward movement. Accordingly, as compared with a case in which the auxiliary propulsion device 30 is driven to generate a thrust for rearward movement, the rotational moment to rotate the hull 10 is increased to improve the rotating speed of the hull 10.

According to a preferred embodiment of the present invention, the steering angle range A20 of the auxiliary propulsion device 30 is about 60 degrees or more and about 80 degrees or less in each of the clockwise and counterclockwise directions. Accordingly, the auxiliary propulsion device 30 is steered to a rudder angle sufficient for only the auxiliary propulsion device 30 to rotate the hull 10, and thus a structure in which the hull 10 is rotated by driving the auxiliary propulsion device 30 without generating a thrust from the main propulsion device 20 is easily achieved.

According to a preferred embodiment of the present invention, the controller 50 is configured or programmed to perform a control to rotate the hull 10 by driving the auxiliary propulsion device 30 when the joystick 43 corresponding to an operator to operate the hull 10 is rotated. Accordingly, the operating direction (rotating direction) of the joystick 43 is the same as the moving direction (rotating direction) of the hull 10, and thus the joystick 43 is operated in an intuitively easy-to-understand state to rotate the hull 10.

According to a preferred embodiment of the present invention, the main propulsion device 20 is an engine outboard motor including the engine 22 to drive the main propeller 21 corresponding to a main thruster that generates a thrust and provided on the centerline 91 of the hull 10 in the right-left direction. Furthermore, the auxiliary propulsion device 30 is an electric outboard motor including the electric motor 32 to drive the auxiliary propeller 31 corresponding to an auxiliary thruster and provided to one side of the centerline of the hull 10 in the right-left direction. Accordingly, in a structure including a plurality of propulsion devices having different maximum outputs, the main propulsion device 20 of which is an engine outboard motor provided on the centerline 91 of the hull 10 in the right-left direction and the auxiliary propulsion device 30 of which is an electric outboard motor provided to one side of the centerline of the hull 10 in the right-left direction, the hull 10 is rotated while the control by the controller 50 is prevented from being complex.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the main propulsion device 20 is preferably an engine outboard motor including the engine 22 to drive the main propeller 21 corresponding to a main thruster that generates a thrust, and the auxiliary propulsion device 30 is preferably an electric outboard motor including the electric motor 32 to drive the auxiliary propeller 31 corresponding to an auxiliary thruster in preferred embodiments described above, the present invention is not restricted to this. In the present invention, the main propulsion device may alternatively be an electric outboard motor including an electric motor to drive the main propeller corresponding to a main thruster. Furthermore, the main propulsion device and the auxiliary propulsion device may alternatively be inboard motors enclosed within the hull instead of outboard motors, or inboard-outboard motors partially enclosed within the hull.

While the controller 50 preferably performs a control to rotate the hull 10 by driving the auxiliary propulsion device 30 when the joystick 43 corresponding to an operator to operate the hull 10 is rotated in preferred embodiments described above, the present invention is not restricted to this. In the present invention, the controller may alternatively perform a control to rotate the hull by driving the auxiliary propulsion device when an operation is performed on an operator other than the joystick to rotate the hull.

While the main propulsion device 20 is preferably steerable by about 30 degrees to each of the L side (the left side of the hull) and the R side (the right side of the hull) in preferred embodiments described above, the present invention is not restricted to this. In the present invention, the main propulsion device may alternatively be steerable by an angle other than about 30 degrees to each of the left side and the right side of the hull as long as the steering angle range of the auxiliary propulsion device is wider than the steering angle range of the main propulsion device.

While the steering angle range A20 of the auxiliary propulsion device 30 is preferably about 60 degrees or more and about 80 degrees or less in each of the clockwise and counterclockwise directions in preferred embodiments described above, the present invention is not restricted to this. In the present invention, the steering angle range of the auxiliary propulsion device may alternatively be less than about 60 degrees or more than about 80 degrees in each of the clockwise and counterclockwise directions as long as the steering angle range of the auxiliary propulsion device is wider than the steering angle range of the main propulsion device.

While the controller 50 preferably performs a control to rotate the hull 10 by driving the auxiliary propulsion device 30 to generate a thrust for forward movement in preferred embodiments described above, the present invention is not restricted to this. In the present invention, the controller may alternatively perform a control to rotate the hull by driving the auxiliary propulsion device to generate a thrust for rearward movement.

While the controller 50 preferably performs a control to rotate the hull 10 by driving the auxiliary propulsion device 30 without generating a thrust from the main propulsion device 20 with the rudder angle A1 of the main propulsion device 20 changed to the same side in the right-left direction as the rudder angle A2 of the auxiliary propulsion device 30 up to the end of the steering angle range A10 of the main propulsion device 20 in preferred embodiments described above, the present invention is not restricted to this. In the present invention, the controller may alternatively perform a control to rotate the hull by driving the auxiliary propulsion device without generating a thrust from the main propulsion device and with the rudder angle of the main propulsion device changed to the same side in the right-left direction as the rudder angle of the auxiliary propulsion device up to some point between the beginning and the end of the steering angle range of the main propulsion device.

While the controller 50 preferably performs a control to rotate the hull 10 by driving the auxiliary propulsion device 30 without generating a thrust from the main propulsion device 20 with the rudder angle A1 of the main propulsion device 20 changed to the same side in the right-left direction as the rudder angle A2 of the auxiliary propulsion device 30 in preferred embodiments described above, the present invention is not restricted to this. In the present invention, the controller may alternatively perform a control to rotate the hull by driving the auxiliary propulsion device without generating a thrust from the main propulsion device in a state in which the rudder angle of the main propulsion device is not changed to the same side in the right-left direction as the rudder angle of the auxiliary propulsion device.

While the main propulsion device 20 is preferably provided on the centerline 91 of the hull 10 in the right-left direction, and the auxiliary propulsion device 30 is preferably provided to one side of the centerline of the hull 10 in the right-left direction in preferred embodiments described above, the present invention is not restricted to this. In the present invention, the main propulsion device may alternatively be provided to one side of the centerline of the hull in the right-left direction, and the auxiliary propulsion device may alternatively be provided on the centerline of the hull in the right-left direction.

While only one main propulsion device 20 is preferably attached to the stern 11 of the hull 10 in preferred embodiments described above, the present invention is not restricted to this. In the present invention, two or more main propulsion devices may alternatively be attached to the stern of the hull.

While only one auxiliary propulsion device 30 is preferably attached to the stern 11 of the hull 10 in preferred embodiments described above, the present invention is not restricted to this. In the present invention, two or more auxiliary propulsion devices may alternatively be attached to the stern of the hull.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion system comprising:

a main propulsion device to be attached to a stern of a hull and operable to rotate in a right-left direction to change a direction of a thrust;

an auxiliary propulsion device to be attached to the stern, including an electric motor to drive an auxiliary thruster to generate a thrust, operable to rotate in the right-left direction to change a direction of the thrust, having a maximum output smaller than a maximum output of the main propulsion device, and having a steering angle range wider than a steering angle range of the main propulsion device; and a controller configured or programmed to perform a control to rotate the hull by driving the auxiliary propulsion device without generating the thrust from the main propulsion device; wherein the controller is configured or programmed to perform a control to rotate the hull by driving the auxiliary propulsion device without generating the thrust from the main propulsion device and with a rudder angle of the main propulsion device changed to a same side in the right-left direction as a rudder angle of the auxiliary propulsion device.

2. The marine propulsion system according to claim 1, wherein the main propulsion device is provided on a centerline of the hull in the right-left direction; and the auxiliary propulsion device is provided to one side of the centerline of the hull in the right-left direction.

3. The marine propulsion system according to claim 2, wherein the controller is configured or programmed to control an output of the auxiliary propulsion device and the rudder angle of the auxiliary propulsion device such that a rotational moment to rotate the hull counterclockwise is equal or substantially equal to a rotational moment to rotate the hull clockwise.

4. The marine propulsion system according to claim 3, wherein the controller is configured or programmed to perform a control to make the output and the rudder angle of the auxiliary propulsion device to rotate the hull counterclockwise different from the output and the rudder angle of the auxiliary propulsion device to rotate the hull clockwise such that the rotational moment to rotate the hull counterclockwise is equal or substantially equal to the rotational moment to rotate the hull clockwise.

5. The marine propulsion system according to claim 1, wherein the controller is configured or programmed to perform a control to rotate the hull by driving the auxiliary propulsion device without generating the thrust from the main propulsion device and with the rudder angle of the main propulsion device changed to the same side in the right-left direction as the rudder angle of the auxiliary propulsion device up to an end of the steering angle range of the main propulsion device.

6. The marine propulsion system according to claim 1, wherein the auxiliary propulsion device has a maximum value of a power range when generating a thrust for forward movement larger than a maximum value of a power range when generating a thrust for rearward movement; and the controller is configured or programmed to perform a control to rotate the hull by driving the auxiliary propulsion device to generate the thrust for forward movement.

7. The marine propulsion system according to claim 1, wherein the steering angle range of the auxiliary propulsion device is about 60 degrees or more and about 80 degrees or less in each of clockwise and counterclockwise directions.

8. The marine propulsion system according to claim 1, wherein the controller is configured or programmed to perform a control to rotate the hull by driving the auxiliary propulsion device when a joystick corresponding to an operator to operate the hull is rotated.

9. The marine propulsion system according to claim 1, wherein the main propulsion device is an engine outboard motor including an engine to drive a main propeller corresponding to a main thruster that generates the thrust and provided on a centerline of the hull in the right-left direction; and the auxiliary propulsion device is an electric outboard motor including the electric motor to drive an auxiliary propeller corresponding to the auxiliary thruster and provided to one side of the centerline of the hull in the right-left direction.

10. A marine propulsion system comprising:

a main propulsion device to be attached to a stern of a hull and operable to rotate in a right-left direction to change a direction of a thrust;

an auxiliary propulsion device to be attached to the stern, operable to rotate in the right-left direction to change a direction of a thrust, having a maximum output smaller than a maximum output of the main propulsion device, and having a steering angle range wider than a steering angle range of the main propulsion device; and a controller configured or programmed to perform a control to rotate the hull by driving the auxiliary propulsion device without generating the thrust from the main propulsion device; wherein the controller is configured or programmed to perform a control to rotate the hull by driving the auxiliary propulsion device without generating the thrust from the main propulsion device and with a rudder angle of the main propulsion device changed to a same side in the right-left direction as a rudder angle of the auxiliary propulsion device.

11. A marine vessel comprising:

a hull; and a marine propulsion system provided on or in the hull; wherein the marine propulsion system includes:

a main propulsion device attached to a stern of the hull and operable to rotate in a right-left direction to change a direction of a thrust;

an auxiliary propulsion device attached to the stern, including an electric motor to drive an auxiliary thruster to generate a thrust, operable to rotate in the right-left direction to change a direction of the thrust, having a maximum output smaller than a maximum output of the main propulsion device, and having a steering angle range wider than a steering angle range of the main propulsion device; and a controller configured or programmed to perform a control to rotate the hull by driving the auxiliary propulsion device without generating the thrust from the main propulsion device; wherein the controller is configured or programmed to perform a control to rotate the hull by driving the auxiliary propulsion device without generating the thrust from the main propulsion device and with a rudder angle of the main propulsion device changed to a same side in the right-left direction as a rudder angle of the auxiliary propulsion device.

12. The marine vessel according to claim 11, wherein the main propulsion device is provided on a centerline of the hull in the right-left direction; and the auxiliary propulsion device is provided to one side of the centerline of the hull in the right-left direction.

13. The marine vessel according to claim 12, wherein the controller is configured or programmed to control an output of the auxiliary propulsion device and the rudder angle of the auxiliary propulsion device such that a rotational moment to rotate the hull counterclockwise is equal or substantially equal to a rotational moment to rotate the hull clockwise.

14. The marine vessel according to claim 13, wherein the controller is configured or programmed to perform a control to make the output and the rudder angle of the auxiliary propulsion device to rotate the hull counterclockwise different from the output and the rudder angle of the auxiliary propulsion device to rotate the hull clockwise such that the rotational moment to rotate the hull counterclockwise is equal or substantially equal to the rotational moment to rotate the hull clockwise.

15. The marine vessel according to claim 11, wherein the controller is configured or programmed to perform a control to rotate the hull by driving the auxiliary propulsion device without generating the thrust from the main propulsion device and with the rudder angle of the main propulsion device changed to the same side in the right-left direction as the rudder angle of the auxiliary propulsion device up to an end of the steering angle range of the main propulsion device.

16. The marine vessel according to claim 11, wherein the auxiliary propulsion device has a maximum value of a power range when generating a thrust for forward movement larger than a maximum value of a power range when generating a thrust for rearward movement; and the controller is configured or programmed to perform a control to rotate the hull by driving the auxiliary propulsion device to generate the thrust for forward movement.

17. The marine vessel according to claim 11, wherein the steering angle range of the auxiliary propulsion device is about 60 degrees or more and about 80 degrees or less in each of clockwise and counterclockwise directions.

18. The marine vessel according to claim 11, wherein the controller is configured or programmed to perform a control to rotate the hull by driving the auxiliary propulsion device when a joystick corresponding to an operator to operate the hull is rotated.

* * * * *